US009416755B2

(12) United States Patent
Dudar

(10) Patent No.: US 9,416,755 B2
(45) Date of Patent: Aug. 16, 2016

(54) SYSTEMS AND METHODS FOR DETERMINING CANISTER PURGE VALVE DEGRADATION

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 96 days.

(21) Appl. No.: 14/560,573

(22) Filed: Dec. 4, 2014

(65) Prior Publication Data

US 2016/0160808 A1 Jun. 9, 2016

(51) Int. Cl.

| | |
|---|---|
| ***F02M 33/00*** | (2006.01) |
| ***F02M 25/08*** | (2006.01) |
| ***F02D 41/00*** | (2006.01) |
| ***F02D 41/26*** | (2006.01) |
| ***F02D 35/00*** | (2006.01) |

(52) U.S. Cl.

CPC ..... *F02M 25/0809* (2013.01); *F02D 35/0015* (2013.01); *F02D 41/004* (2013.01); *F02D 41/26* (2013.01); *F02M 25/0836* (2013.01); *F02M 25/0854* (2013.01)

(58) Field of Classification Search

CPC ..... F02M 25/0809; F02M 25/0836; F02M 25/0854; F02D 41/004; F02D 41/26; F02D 35/0015

USPC ..... 701/103, 104, 107, 109; 123/516, 123/518–520

See application file for complete search history.

(56) References Cited

U.S. PATENT DOCUMENTS

| | | | |
|---|---|---|---|
| 5,754,971 | A | 5/1998 | Matsumoto et al. |
| 6,102,364 | A | 8/2000 | Busato |
| 6,321,727 | B1 | 11/2001 | Reddy et al. |
| 6,363,921 | B1 | 4/2002 | Cook et al. |
| 6,550,316 | B1 | 4/2003 | Wong et al. |
| 6,830,039 | B2 | 12/2004 | Duty et al. |
| 6,840,233 | B2 | 1/2005 | Lingenhult et al. |

(Continued)

FOREIGN PATENT DOCUMENTS

| | | |
|---|---|---|
| EP | 0811152 B1 | 7/2000 |
| JP | 4342713 B2 | 10/2009 |

OTHER PUBLICATIONS

Grieve, M. James et al., "Advanced Canister Purge Algorithm with a Virtual [HC] Sensor," SAE Technical Paper Series No. 2000 01 0557, SAE 2000 World Congress, Detroit, MI., Mar. 6-9, 2000, 9 pages.

(Continued)

*Primary Examiner* — Hai Huynh

(74) *Attorney, Agent, or Firm* — James Dottavio; Alleman Hall McCoy Russell & Tuttle LLP

(57) ABSTRACT

A method is provided, comprising: during a first condition, opening a fuel tank isolation valve while maintaining a canister purge valve closed; and indicating degradation of the canister purge valve based on an output of a universal exhaust gas oxygen (UEGO) sensor. The UEGO sensor output will indicate whether any fuel vapor vented from the fuel tank reaches intake through the commanded closed canister purge valve. In this way, canister purge valve degradation may be diagnosed in vehicles that do not include a functional fuel tank pressure sensor or canister vent valve.

20 Claims, 6 Drawing Sheets

(56) References Cited

U.S. PATENT DOCUMENTS

| | | | |
|---|---|---|---|
| 7,124,018 | B2 | 10/2006 | Hassdenteufel et al. |
| 7,131,322 | B2 | 11/2006 | Booms et al. |
| 7,753,035 | B2 | 7/2010 | Collet |
| 7,810,475 | B2 | 10/2010 | Peters et al. |
| 8,122,758 | B2 | 2/2012 | Wang et al. |
| 8,215,291 | B2 | 7/2012 | DeBastos et al. |
| 8,327,691 | B2 | 12/2012 | Drane et al. |
| 8,371,272 | B1 | 2/2013 | Martin et al. |
| 8,434,461 | B2 | 5/2013 | Kerns et al. |
| 2009/0293599 | A1 | 12/2009 | McLain et al. |
| 2011/0295482 | A1 | 12/2011 | Pearce et al. |
| 2014/0374177 | A1 | 12/2014 | Yang et al. |

OTHER PUBLICATIONS

Authors et al.: Disclosed Anonymously, "Onboard Arbitration of Engine Lean DTCS P2196/P2198," http://ip.com/IPCOM/000234979, Published by IP.com, IP.com No. IPCOM000234979D, Feb. 20, 2014, 2 pages.

Authors et al.: Disclosed Anonymously, "A Method to Infer CPV Leakage Learning and Perform Compensation," http://ip.com/IPCOM/000235605, Published by IP.com, IP.com No. IPCOM000235605D, Mar. 11, 2014, 2 pages.

SYSTEMS AND METHODS FOR DETERMINING CANISTER PURGE VALVE DEGRADATION

BACKGROUND AND SUMMARY

A leaky canister purge valve is a common cause of a lean engine condition, as unmetered air is brought into the intake manifold. Indeed, following a lean engine diagnostic with a CPV integrity test may pinpoint the problem, and prevent warranty testing of all potential causes of a lean engine.

A canister purge valve diagnostic typically comprises closing the canister purge valve and canister vent valve while a threshold vacuum exists in the intake manifold. The diagnostic then monitors fuel tank pressure. If a vacuum build is detected at the fuel tank, a leaky canister purge valve diagnostic code is set.

However, while vehicles sold in North America are required to perform on-board evaporative emissions diagnostics, European Union (EU) and Rest of World (ROW) vehicles are not. As such, vehicle manufacturers may omit the fuel tank pressure transducer and/or the canister vent valve to reduce manufacturing costs. Without the CVV and fuel tank pressure sensor, this type of canister purge valve diagnostic is not practical.

The inventors herein have recognized the above issues and have developed systems and methods to at least partially address them. In one example, a method is provided, comprising: during a first condition, opening a fuel tank isolation valve while maintaining a canister purge valve closed; and indicating degradation of the canister purge valve based on an output of a universal exhaust gas oxygen (UEGO) sensor. The UEGO sensor output will indicate whether any fuel vapor vented from the fuel tank reaches intake through the commanded closed canister purge valve. In this way, canister purge valve degradation may be diagnosed in vehicles that do not include a functional fuel tank pressure sensor or canister vent valve.

In another example, a fuel system for a vehicle is provided, comprising: a fuel tank coupled to a fuel vapor canister via a fuel tank isolation valve; an engine intake coupled to the fuel vapor canister via a canister purge valve; an universal exhaust gas oxygen (UEGO) sensor coupled to an engine exhaust; and a controller configured with instructions stored in non-transitory memory, that when executed, cause the controller to: responsive to an engine lean code, open the fuel tank isolation valve while maintaining the canister purge valve closed; and indicate degradation of the canister purge valve based on an output of the UEGO sensor. In this way, lean engine codes may be arbitrated into canister purge valve degradations and other lean engine code causes. This may decrease warranty costs associated with diagnosing the root cause of the lean engine code.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

FIG. 1 schematically shows an example vehicle propulsion system.

FIG. 2 schematically shows an example vehicle system with a fuel system and an evaporative emissions system.

FIG. 3 schematically shows an example vehicle system with a fuel system and an evaporative emissions system.

DETAILED DESCRIPTION

Figure 1:
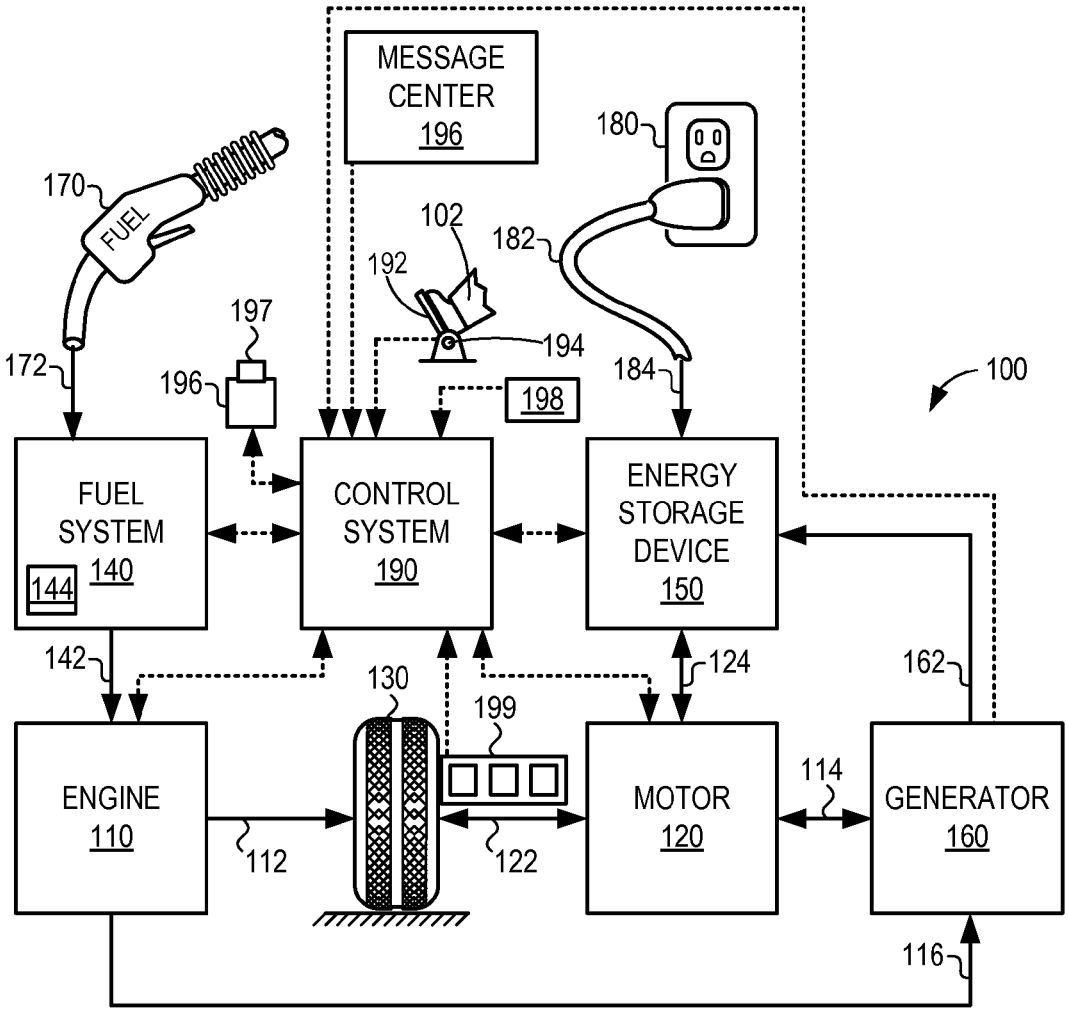
Figure 2:
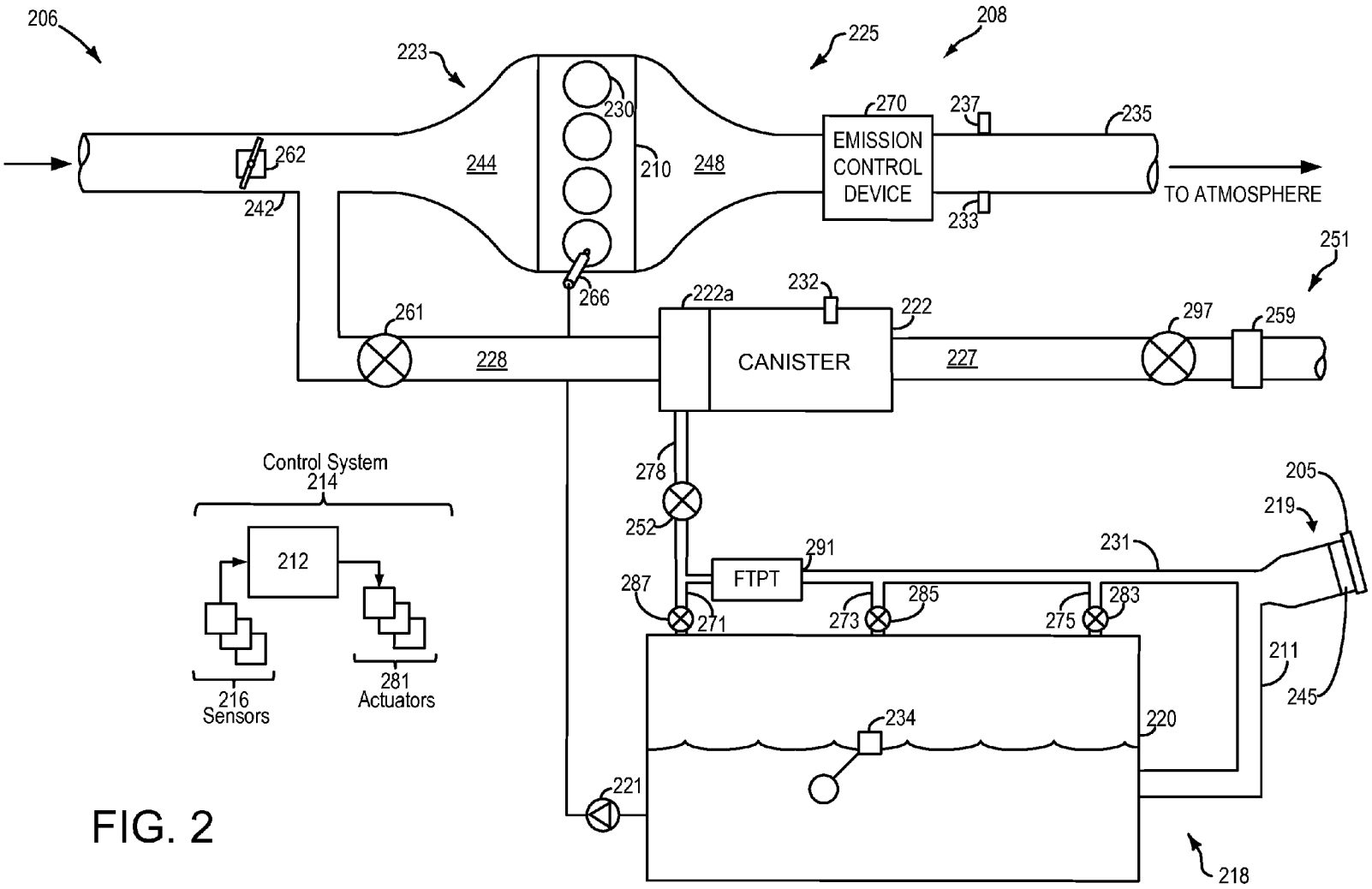
Figure 3:
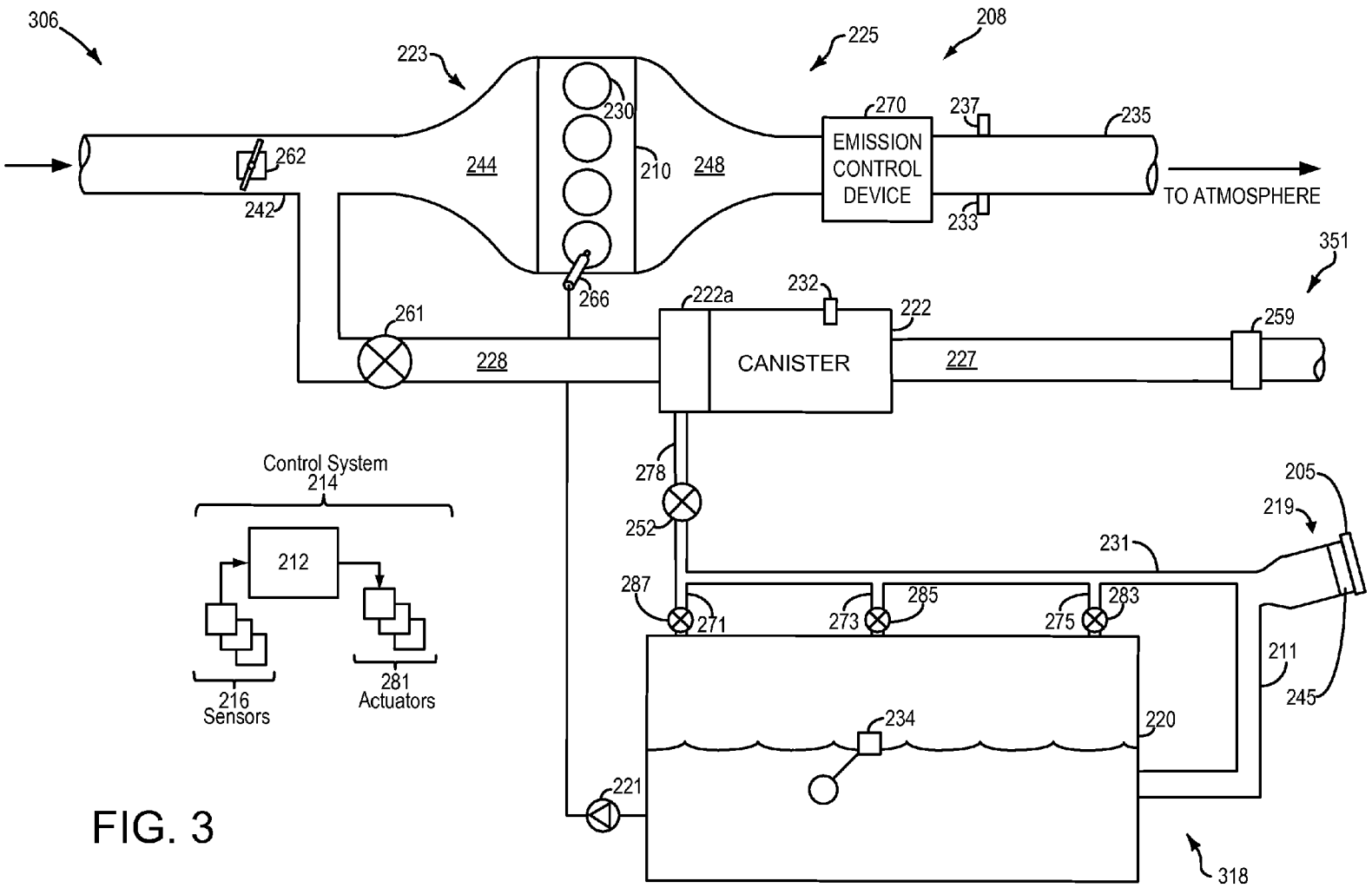
Figure 4:
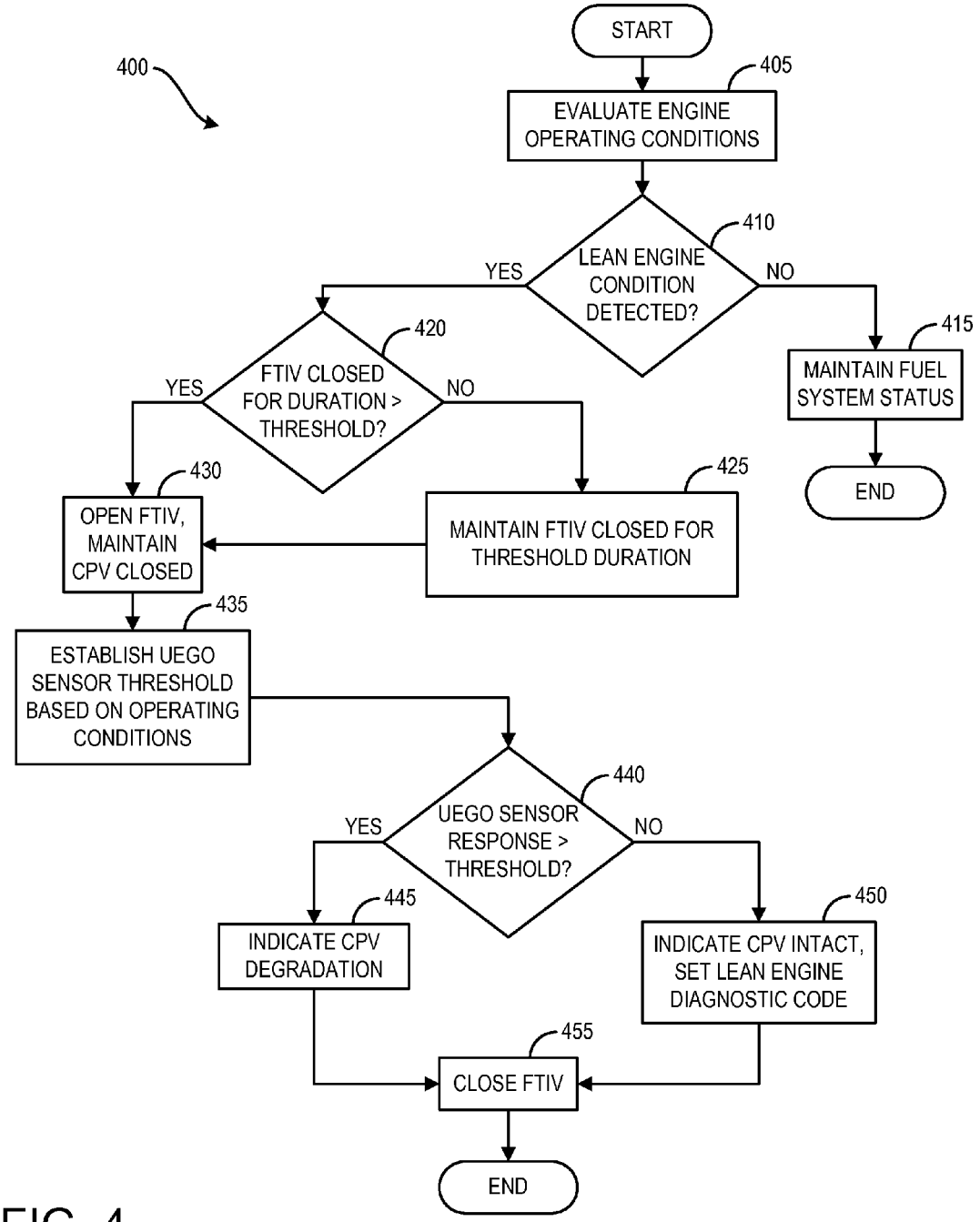
FIG. 4 shows a flow-chart for an example high level method for arbitrating a lean engine code.
Figure 5:
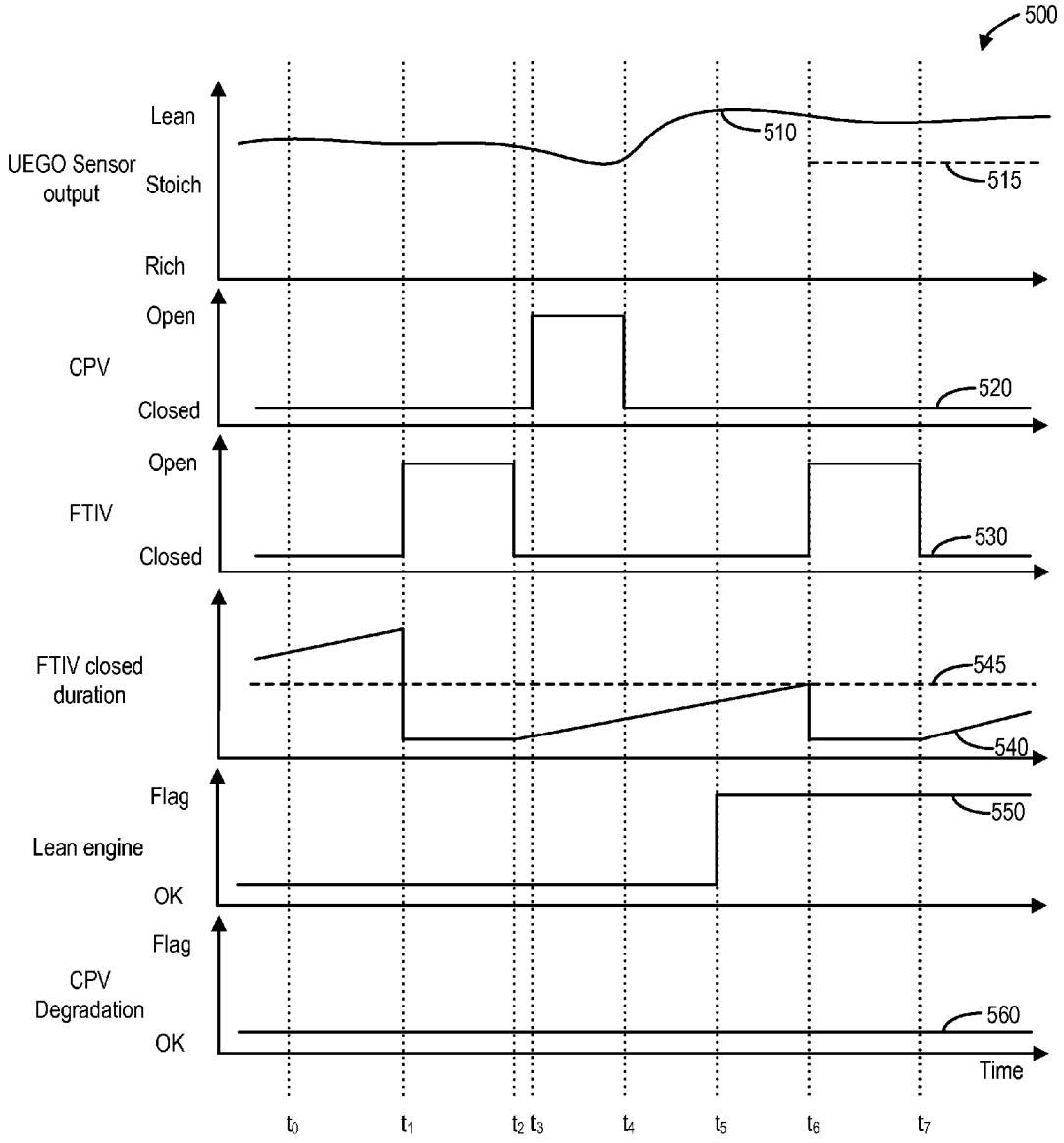
FIG. 5 shows an example timeline for arbitrating a lean engine code where a canister purge valve is intact.
Figure 6:
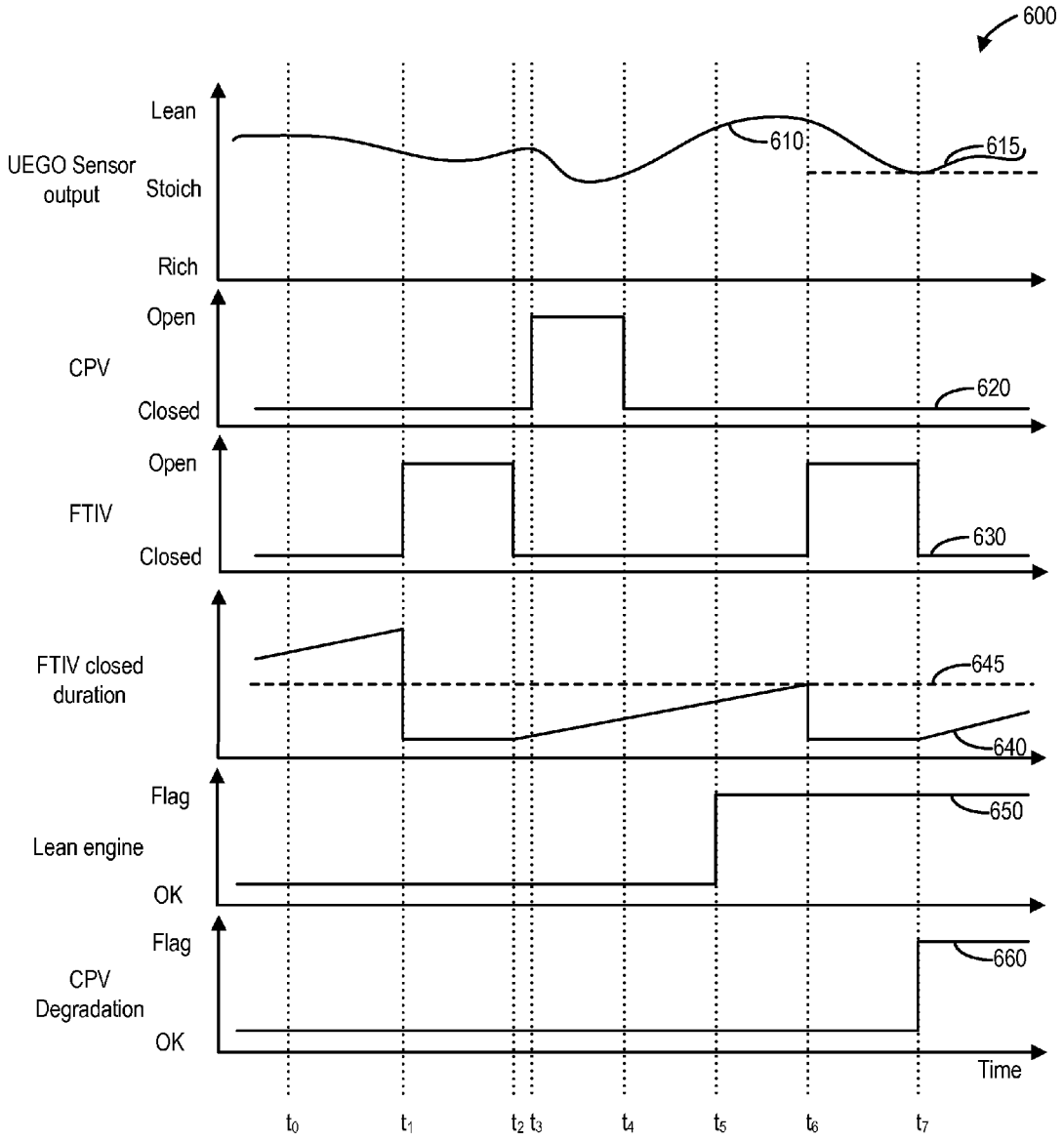
FIG. 6 shows an example timeline for arbitrating a lean engine code where a canister purge valve is degraded.

This detailed description is related to systems and methods for determining the integrity of a fuel system. In particular, the description relates to arbitrating lean engine codes by determining the integrity of a canister purge valve independent of fuel tank pressure and regardless of the presence of a canister vent valve. A vehicle, such as the vehicle propulsion system shown in FIG. 1 may include an engine system coupled to a fuel system and an evaporative emissions system, as shown in FIG. 2. A primary cause of a lean engine code being set is leakage through a canister purge valve. A typical method of testing the canister purge valve includes sealing the evaporative emissions system and applying engine vacuum across a closed canister purge valve. However, EU and ROW vehicle models may omit a canister vent valve and fuel tank pressure sensor, as shown in FIG. 3. FIG. 4 describes an example method of testing the integrity of the canister purge valve for such vehicles. FIG. 5 shows an example timeline for a test using the method of FIG. 4 where the canister purge valve is intact. FIG. 6 shows an example timeline for a test using the method of FIG. 4 where the canister purge valve is leaking FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g. gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e. set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162. During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g. E10, E85, etc.) or a blend of gasoline and methanol (e.g. M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. As will be described by the process flows of FIGS. 5, 6, and 7, control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g. not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g. as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, as described in more detail below, in response to the vehicle operator actuating refueling button 197, a fuel tank in the vehicle may be depressurized so that refueling may be performed.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

FIG. 2 shows a schematic depiction of a vehicle system 206. The vehicle system 206 includes an engine system 208 coupled to an emissions control system 251 and a fuel system 218. Emission control system 251 includes a fuel vapor container or canister 222 which may be used to capture and store fuel vapors. In some examples, vehicle system 206 may be a hybrid electric vehicle system.

The engine system 208 may include an engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 218 may include a fuel tank 220 coupled to a fuel pump system 221. The fuel pump system 221 may include one or more pumps for pressurizing fuel delivered to the injectors of engine 210, such as the example injector 266 shown. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an evaporative emissions control system 251 which includes a fuel vapor canister 222 via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe or neck 211.

Further, refueling system 219 may include refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222 filled with an appropriate adsorbent, the canisters are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 251 may further include a canister ventilation path or vent line 227 which may route gases out of the canister 222 to the atmosphere when storing, or trapping, fuel vapors from fuel system 218.

Canister 222 may include a buffer 222*a* (or buffer region), each of the canister and the buffer comprising the adsorbent. As shown, the volume of buffer 222*a* may be smaller than (e.g., a fraction of) the volume of canister 222. The adsorbent in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine. One or more temperature sensors 232 may be coupled to and/or within canister 222. As fuel vapor is adsorbed by the adsorbent in the canister, heat is generated (heat of adsorption). Likewise, as fuel vapor is desorbed by the adsorbent in the canister, heat is consumed.

In this way, the adsorption and desorption of fuel vapor by the canister may be monitored and estimated based on temperature changes within the canister.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake manifold 244 is provided to the fuel vapor canister for purging. In some examples, vent line 227 may include an air filter 259 disposed therein upstream of a canister 222.

In some examples, the flow of air and vapors between canister 222 and the atmosphere may be regulated by a canister vent valve coupled within vent line 227. When included, the canister vent valve may be a normally open valve, so that fuel tank isolation valve 252 (FTIV) may control venting of fuel tank 220 with the atmosphere. FTIV 252 may be positioned between the fuel tank and the fuel vapor canister within conduit 278. FTIV 252 may be a normally closed valve, that when opened, allows for the venting of fuel vapors from fuel tank 220 to canister 222. Fuel vapors may then be vented to atmosphere, or purged to engine intake system 223 via canister purge valve 261.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open isolation valve 252 while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open isolation valve 252, while maintaining canister purge valve 261 closed, to depressurize the fuel tank before allowing enabling fuel to be added therein. As such, isolation valve 252 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 212 may open canister purge valve 261 while closing isolation valve 252. Herein, the vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold.

Controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include universal exhaust gas oxygen (UEGO) sensor 237 located upstream of the emission control device, temperature sensor 233, pressure sensor 291, and canister temperature sensor 243. Other sensors such as pressure, temperature, air/fuel ratio, and composition sensors may be coupled to various locations in the vehicle system 206. As another example, the actuators may include fuel injector 266, throttle 262, fuel tank isolation valve 253, pump 292, and refueling lock 245. The control system 214 may include a controller 212. The controller may receive input data from the various sensors, process the input data, and trigger the actuators in response to the processed input data based on instruction or code programmed therein corresponding to one or more routines. An example control routine is described herein with regard to FIG. 4.

Leak detection routines may be intermittently performed by controller 212 on fuel system 218 to confirm that the fuel system is not degraded. As such, leak detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, leak detection routines may be performed while the engine is running by operating a vacuum pump and/or using engine intake manifold vacuum.

In some configurations, a canister vent valve (CVV) 297 may be coupled within vent line 227. CVV 297 may function to adjust a flow of air and vapors between canister 222 and the atmosphere. The CVV may also be used for diagnostic routines. When included, the CVV may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the CVV may be opened to allow a flow of fresh air to strip the fuel vapors stored in the canister. In some examples, CVV 297 may be a solenoid valve wherein opening or closing of the valve is performed via actuation of a canister vent solenoid. In particular, the canister vent valve may be an open that is closed upon actuation of the canister vent solenoid. In some examples, CVV 297 may be configured as a latchable solenoid valve. In other words, when the valve is placed in a closed configuration, it latches closed without requiring additional current or voltage. For example, the valve may be closed with a 100 ms pulse, then opened at a later time point with another 100 ms pulse. In this way, the amount of battery power required to maintain the CVV closed is reduced. In particular, the CVV may be closed while the vehicle is off, thus maintaining battery power while maintaining the fuel emissions control system sealed from atmosphere.

While vehicles sold in North America are required to perform on-board evaporative emissions diagnostics, European Union (EU) and Rest of World (ROW) vehicles are not. As such, vehicle manufacturers may omit the fuel tank pressure transducer and/or the canister vent valve to reduce manufacturing costs. FIG. 3 shows an example EU/ROW vehicle system 306. Vehicle system 306 includes fuel system 318, which does not include a fuel tank pressure sensor. Vehicle system 306 further includes evaporative emissions system 351, which does not include a canister vent valve coupled within vent line 227.

Vehicle system 306 is thus not capable of executing some of the on-board evaporative emissions tests performed by vehicle system 206. For example, a canister purge valve diagnostic typically comprises closing the CPV and CVV while a threshold vacuum exists in the intake manifold. The diagnostic then monitors fuel tank pressure. If a vacuum build is detected at the fuel tank, a leaky CPV diagnostic code is set. However, without the CVV and fuel tank pressure sensor, this routine is not practical. A leaky CPV is a common cause of a lean engine condition, as unmetered air is brought into the intake manifold. Indeed, following a lean engine diagnostic with a CPV integrity test may pinpoint the problem, and prevent warranty testing of all potential causes of a lean engine.

FIG. 4 shows a flow chart for an example high-level method 400 for arbitrating a lean engine code. Specifically, method 400 may be used to diagnose a leaky CPV independent of fuel tank pressure, and without the use of a CVV. Method 400 will be described with relation to the systems shown in FIGS. 1-3, but it should be understood that similar methods may be used with other systems without departing from the scope of this disclosure. Method 400 may be stored as instructions in non-transitory memory and carried out by controller 212. Method 400 may begin at 405 by estimating operating conditions. Operating conditions may be measured, estimated, or inferred, and may include ambient conditions, such as temperature, humidity, and barometric pressure, engine conditions, such as manifold adjusted pressure, engine operating status, engine speed, engine load, etc., as well as vehicle conditions, such as, fuel level, fuel vapor canister load status, etc.

Continuing at 410, method 400 may include determining whether a lean engine condition has been detected. A lean engine condition may be determined based on the output of a UEGO sensor. A lean engine diagnostic code may be set if the sensor output indicates that an exhaust oxygen content is above a threshold for a previously determined duration. If a lean engine condition is not detected, method 400 may proceed to 415. At 415, method 400 may include maintaining the status of the vehicle fuel system. Method 400 may then end.

If a lean engine condition is detected, method 400 may proceed to 420. At 420, method 400 may include determining whether a fuel tank isolation valve has been closed for a duration greater than a threshold. Operating the vehicle with the FTIV closed will cause pressure inside the fuel tank to rise as a result of running loss vapor an heat generation. In vehicles such as vehicle system 206, where a fuel tank pressure sensor is included, the fuel tank pressure may be compared to a threshold. However, for vehicles such as vehicle system 306, where the fuel tank pressure sensor is omitted, or vehicles where the fuel tank pressure sensor is degraded, closing the FTIV for a threshold duration may be sufficient to infer that a threshold amount of fuel vapor has accumulated within the fuel tank. The threshold duration may be based on operating conditions, such as fuel tank fill level, fuel composition, and engine temperature. If the FTIV has not been closed for a threshold duration, method 400 may proceed to 425. At 425, method 400 may include maintaining the FTIV closed for the threshold duration.

When the FTIV has been closed for the threshold duration, method 400 may proceed to 430. At 430, method 400 may include opening the FTIV while maintaining the CPV closed. Opening the FTIV will allow the built-up fuel vapor to enter the fuel vapor canister buffer under pressure. If the CPV is leaking, and thus the intake coupled to atmosphere via the canister, some of the fuel vapor will be drawn into intake, where it will be combusted. As this influx will not be compensated for by the controller, the UEGO sensor should respond in turn.

Continuing at 435, method 400 may include establishing an UEGO sensor threshold based on operating conditions. The UEGO sensor threshold may be a change in the exhaust oxygen content indicating that fuel vapor has entered intake through a leaky CPV. The UEGO sensor threshold may be based at least in part on ambient temperature, vehicle temperature, fuel level, altitude, fuel composition, engine load, and/or other operating conditions. Continuing at 440, method 400 may include determining whether the UEGO sensor response to the FTIV opening is greater than the threshold. If the UEGO sensor response is greater than the threshold, method 400 may proceed to 445. At 445, method 400 may include indicating degradation in the CPV. CPV degradation may be indicated by setting and storing a flag or diagnostic code at the controller, and may further include indicating a fault to a vehicle operator, such as by illuminating a malfunction indicator light on the vehicle dashboard.

If the UEGO sensor response is not greater than the threshold, method 400 may proceed to 450. At 450, method 400 may include indicating that the CPV is intact, and may further include setting a lean engine diagnostic code. The lean engine diagnostic code may be indicated by setting and storing a flag or diagnostic code at the controller, and may further include indicating a fault to a vehicle operator, such as by illuminating a malfunction indicator light on the vehicle dashboard. In some examples, the lean engine diagnostic code may include an indication to initiate other diagnostic routines. Once CPV degradation and/or a lean engine have been indicated, method 400 may proceed to 455. At 455, method 400 may include closing the FTIV. Other action may be taken by the controller in response to an indication of CPV degradation. For example, a commanded air/fuel ratio may be adjusted responsive to the indication of degradation of the canister purge valve. In some examples, a canister purge schedule may be adjusted, and/or the expected load introduced during a canister purge cycle may be adjusted. The fuel tank isolation valve may be maintained closed outside of refueling events. Method 400 may then end.

FIG. 5 shows an example timeline 500 for arbitrating a lean engine code where a canister purge valve is intact, using the method described herein and with regards to FIG. 4 as applied to the system described herein and with regards to FIGS. 1 and 3. Timeline 500 includes plot 510, indicating an output of an UEGO sensor over time. A lean UEGO sensor output indicates an increased amount of exhaust gas oxygen as compared to a rich UEGO sensor output. Line 515 indicates an UEGO sensor threshold. Timeline 500 further includes plot 520, indicating the status of a CPV over time. Timeline 500 further includes plot 530, indicating the status of an FTIV over time. Timeline 500 further includes plot 540, indicating the cumulative time the FTIV has been closed. Line 545 indicates a FTIV closed duration threshold. Timeline 500 further includes plot 550, indicating whether a lean engine has been indicated over time, and plot 560, indicating whether CPV degradation has been indicated over time.

At time $t_0$, the CPV and FTIV are closed, as shown by plots 520 and 530, respectively. The UEGO sensor output indicates that the engine is running lean, as shown by plot 510, but a lean engine diagnostic code has not been set. At time $t_1$, the FTIV is opened, venting fuel vapor from the fuel tank to the fuel vapor canister. As the CPV is closed and intact, the UEGO sensor output does not significantly change. The FTIV is maintained open from time $t_1$ to time $t_2$, then closed, at which point the FTIV closed duration is reset and begins increasing. At time $t_3$, the CPV is opened while maintaining the FTIV closed, thus purging fuel vapor from the fuel vapor canister to the engine intake. The CPV is maintained open from time $t_3$ to time $t_4$. During the purge event, the UEGO sensor output trends towards stoichiometric combustion, then decreases as the purge event concludes with the closing of the CPV at time $t_1$.

Following the closing of the CPV at time $t_4$, the UEGO sensor output indicates that the engine is burning lean. At time $t_5$, this results in a lean engine flag being set, as shown by plot 550. However, the FTIV closed duration is less than the threshold represented by line 545. Thus, the FTIV is maintained closed until time $t_6$, when the FTIV closed duration reaches the threshold. At time $t_6$, a UEGO sensor threshold is established based on current operating conditions, as indicated by line 515.

The FTIV is opened at time $t_6$, venting fuel vapor from the fuel tank to the fuel vapor canister. The UEGO sensor output does not reach the threshold, indicating that the CPV is closed and intact. Accordingly, a CPV degradation flag is not set, as shown by plot 560. At time $t_7$, the FTIV is closed, and the FTIV closed duration is reset and begins increasing.

FIG. 6 shows an example timeline 600 for arbitrating a lean engine code where a canister purge valve is leaking, using the method described herein and with regards to FIG. 4 as applied to the system described herein and with regards to FIGS. 1 and 3. Timeline 600 includes plot 610, indicating an output of an UEGO sensor over time. A lean UEGO sensor output indicates an increased amount of exhaust gas oxygen as compared to a rich UEGO sensor output. Line 615 indicates an UEGO sensor threshold. Timeline 600 further includes plot 620, indicating the status of a CPV over time. Timeline 600 further includes plot 630, indicating the status of an FTIV over time. Timeline 600 further includes plot 640, indicating the cumulative time the FTIV has been closed. Line 645 indicates a FTIV closed duration threshold. Timeline 600 further includes plot 650, indicating whether a lean engine has been indicated over time, and plot 660, indicating whether CPV degradation has been indicated over time.

At time $t_0$, the CPV and FTIV are closed, as shown by plots 620 and 630, respectively. The UEGO sensor output indicates that the engine is running lean, as shown by plot 610, but a lean engine diagnostic code has not been set. At time $t_1$, the FTIV is opened, venting fuel vapor from the fuel tank to the fuel vapor canister. The UEGO sensor output trends towards stoich, due to the leaky nature of the CPV. The FTIV is maintained open from time $t_1$ to time $t_2$, then closed, at which point the FTIV closed duration is reset and begins increasing. At time $t_3$, the CPV is opened while maintaining the FTIV closed, thus purging fuel vapor from the fuel vapor canister to the engine intake. The CPV is maintained open from time $t_3$ to time $t_4$. During the purge event, the UEGO sensor output trends towards stoichiometric combustion, then decreases as the purge event concludes with the closing of the CPV at time $t_1$.

Following the closing of the CPV at time $t_4$, the UEGO sensor output indicates that the engine is burning lean. At time $t_5$, this results in a lean engine flag being set, as shown by plot 650. However, the FTIV closed duration is less than the threshold represented by line 645. Thus, the FTIV is maintained closed until time $t_6$, when the FTIV closed duration reaches the threshold. At time $t_6$, a UEGO sensor threshold is established based on current operating conditions, as indicated by line 615.

The FTIV is opened at time $t_6$, venting fuel vapor from the fuel tank to the fuel vapor canister. At time $t_7$, the UEGO sensor output reaches the threshold, indicating that the CPV is leaking Accordingly, a CPV degradation flag is set, as shown by plot 660. The FTIV is closed, and the FTIV closed duration is reset and begins increasing.

The systems described herein and depicted in FIGS. 1-3 along with the method described herein and depicted in FIG. 4 may enable one or more systems and one or more methods. In one example method is provided, comprising: during a first condition, opening a fuel tank isolation valve while maintaining a canister purge valve closed; and indicating degradation of the canister purge valve based on an output of a universal exhaust gas oxygen (UEGO) sensor. The first condition may comprise a lean engine diagnostic code. Indicating degradation of the canister purge valve based on the output of the UEGO sensor may comprise indicating degradation of the canister purge valve responsive to the UEGO sensor indicating a threshold decrease in exhaust gas oxygen. The method may further comprise indicating an intact canister purge valve responsive to the UEGO sensor not indicating a threshold decrease in exhaust gas oxygen. The threshold decrease in exhaust gas oxygen may be based on one or more operating conditions. The one or more operating conditions may include a fuel composition. The one or more operating conditions may not include a fuel tank pressure. The method may further comprise maintaining the fuel tank isolation valve closed until the fuel tank isolation valve closed duration increases above a threshold. In some examples, the method may further comprise adjusting a commanded air/fuel ratio responsive to the indication of degradation of the canister purge valve. The technical result of implementing this method is that canister purge valve degradation may be diagnosed in vehicles that do not include a functional fuel tank pressure sensor or canister vent valve. The UEGO sensor output will indicate whether any fuel vapor vented from the fuel tank reaches intake through the commanded closed canister purge valve.

In another example, a fuel system for a vehicle is provided, comprising: a fuel tank coupled to a fuel vapor canister via a fuel tank isolation valve; an engine intake coupled to the fuel vapor canister via a canister purge valve; an universal exhaust gas oxygen (UEGO) sensor coupled to an engine exhaust; and a controller configured with instructions stored in non-transitory memory, that when executed, cause the controller to: responsive to an engine lean code, open the fuel tank isolation valve while maintaining the canister purge valve closed; and indicate degradation of the canister purge valve based on an output of the UEGO sensor. The fuel vapor canister may be coupled to atmosphere via a vent line, the vent line not comprising a canister vent valve. The fuel tank may not be coupled to a fuel tank pressure sensor. The controller may be further configured with instructions stored in non-transitory memory, that when executed, cause the controller to: establish a UEGO sensor output threshold based on one or more operating conditions; and indicate degradation of the canister purge valve responsive to the UEGO sensor output decreasing below the threshold. In some examples, the controller may be further configured with instructions stored in non-transitory memory, that when executed, cause the controller to: indicate an intact canister purge valve responsive to the UEGO sensor output not decreasing below the threshold. The one or more operating conditions may include a fuel composition. The one or more operating conditions may include a fuel level. The one or more operating conditions may not include a fuel tank pressure. The controller may be further configured with instructions stored in non-transitory memory, that when executed, cause the controller to: open the fuel tank isolation valve responsive to a fuel tank isolation valve closed duration being greater than a threshold. The fuel vapor canister may comprise a fuel vapor canister buffer, and wherein the fuel tank is coupled to a load port of the fuel vapor canister buffer. The technical result of implementing this system is that lean engine codes may be arbitrated into canister purge valve degradations and other lean engine code causes. This may decrease warranty costs associated with diagnosing the root cause of the lean engine code.

In yet another example, a method for a fuel system is provided, comprising: responsive to a lean engine diagnostic code, maintaining a fuel tank isolation valve closed for a threshold duration; opening the fuel tank isolation valve while maintaining a canister purge valve closed; establishing a threshold output of an universal exhaust gas oxygen (UEGO) sensor based on one or more operating conditions; indicating degradation of the canister purge valve responsive to the output of the UEGO sensor decreasing below the threshold; and closing the fuel tank isolation valve. The technical result of implementing this method is a fuel tank pressure sensor independent method of diagnosing canister purge valve leaks. By venting the fuel tank following a fuel tank closed duration, the fuel vapor stored in the fuel tank vapor dome acts as a rich stimulant that may alter the output of the UEGO sensor if the canister purge valve is leaking Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

during a first condition, opening a fuel tank isolation valve while maintaining a canister purge valve closed; and indicating degradation of the canister purge valve based on an output of a universal exhaust gas oxygen (UEGO) sensor.

2. The method of claim 1, wherein the first condition comprises a lean engine diagnostic code.

3. The method of claim 2, wherein indicating degradation of the canister purge valve based on the output of the UEGO sensor comprises indicating degradation of the canister purge valve responsive to the UEGO sensor indicating a threshold decrease in exhaust gas oxygen.

4. The method of claim 3, further comprising:

indicating an intact canister purge valve responsive to the UEGO sensor not indicating a threshold decrease in exhaust gas oxygen.

5. The method of claim 3, wherein the threshold decrease in exhaust gas oxygen is based on one or more operating conditions.

6. The method of claim 5, wherein the one or more operating conditions include a fuel composition.

7. The method of claim 5, wherein the one or more operating conditions do not include a fuel tank pressure.

8. The method of claim 7, further comprising:

maintaining the fuel tank isolation valve closed until the fuel tank isolation valve closed duration increases above a threshold.

9. The method of claim 1, further comprising:

adjusting a commanded air/fuel ratio responsive to the indication of degradation of the canister purge valve.

10. A fuel system for a vehicle, comprising:

a fuel tank coupled to a fuel vapor canister via a fuel tank isolation valve;

an engine intake coupled to the fuel vapor canister via a canister purge valve;

an universal exhaust gas oxygen (UEGO) sensor coupled to an engine exhaust; and a controller configured with instructions stored in non-transitory memory, that when executed, cause the controller to:

responsive to an engine lean code, open the fuel tank isolation valve while maintaining the canister purge valve closed; and indicate degradation of the canister purge valve based on an output of the UEGO sensor.

11. The fuel system of claim 10, wherein the fuel vapor canister is coupled to atmosphere via a vent line, the vent line not comprising a canister vent valve.

12. The fuel system of claim 10, wherein the fuel tank is not coupled to a fuel tank pressure sensor.

13. The fuel system of claim 10, wherein the controller is further configured with instructions stored in non-transitory memory, that when executed, cause the controller to:

establish a UEGO sensor output threshold based on one or more operating conditions; and indicate degradation of the canister purge valve responsive to the UEGO sensor output decreasing below the threshold.

14. The fuel system of claim 13, wherein the controller is further configured with instructions stored in non-transitory memory, that when executed, cause the controller to:

indicate an intact canister purge valve responsive to the UEGO sensor output not decreasing below the threshold.

15. The fuel system of claim 13, where the one or more operating conditions include a fuel composition.

16. The fuel system of claim 13, where the one or more operating conditions include a fuel level.

17. The fuel system of claim 13, where the one or more operating conditions do not include a fuel tank pressure.

18. The fuel system of claim 10, wherein the controller is further configured with instructions stored in non-transitory memory, that when executed, cause the controller to:

open the fuel tank isolation valve responsive to a fuel tank isolation valve closed duration being greater than a threshold.

19. The fuel system of claim 10, wherein the fuel vapor canister comprises a fuel vapor canister buffer, and wherein the fuel tank is coupled to a load port of the fuel vapor canister buffer.

20. A method for a fuel system, comprising:

responsive to a lean engine diagnostic code, maintaining a fuel tank isolation valve closed for a threshold duration;

opening the fuel tank isolation valve while maintaining a canister purge valve closed;

establishing a threshold output of an universal exhaust gas oxygen (UEGO) sensor based on one or more operating conditions;

indicating degradation of the canister purge valve responsive to the output of the UEGO sensor decreasing below the threshold; and closing the fuel tank isolation valve.

* * * * *